US005165384A

United States Patent [19]

Knutson

[11] Patent Number: 5,165,384

[45] Date of Patent: Nov. 24, 1992

[54] BARBEQUE GRILL HOUSING APPARATUS

[76] Inventor: Lori L. Knutson, 3514 SE. 20th, Des Moines, Iowa 50320

[21] Appl. No.: 756,476

[22] Filed: Sep. 9, 1991

[51] Int. Cl.[5] ..... A47B 96/00; F24C 15/36; F23N 5/24

[52] U.S. Cl. ..... 126/25 C; 126/25 R; 126/58; 126/41 R; 126/201; 431/33; 362/154; 362/376; 248/214

[58] Field of Search ..... 126/85 R, 25 R, 25 C, 126/224, 201, 248, 97, 57, 56, 9 R, 500, 544, 59, 58, 41 R; 248/214; 220/9.1, 485, 493, 468, 668, 494; 431/33; 362/376, 380, 154

[56] References Cited

U.S. PATENT DOCUMENTS

| | | | |
|---|---|---|---|
| 1,164,058 | 12/1915 | Bayne | 126/57 |
| 1,179,713 | 4/1916 | Gallsworthy | 126/544 |
| 1,284,579 | 11/1918 | Brown | 220/482 X |
| 1,451,920 | 4/1923 | Nutt | 362/376 |
| 1,461,989 | 7/1923 | Stockham | 220/482 |
| 1,474,401 | 11/1923 | Bramley | 362/376 X |
| 1,565,120 | 12/1925 | Thompson | 220/485 |
| 2,407,124 | 9/1946 | Anderson et al. | 220/493 X |
| 3,915,146 | 10/1975 | Bauer | 126/41 R |
| 4,467,781 | 8/1984 | Campbell | 126/201 |
| 4,836,480 | 6/1989 | Besner | 126/9 R X |
| 4,932,391 | 6/1990 | Bierdeman | 126/30 |
| 5,009,380 | 4/1991 | Fee | 248/214 |
| 5,072,828 | 12/1991 | Irvine | 220/493 X |

*Primary Examiner*—Carl D. Price
*Attorney, Agent, or Firm*—Leon Gilden

[57] ABSTRACT

A housing apparatus is arranged for use in combination with a barbeque grill for mounting to a balcony structure of an existing dwelling. The structure includes mesh side walls and a floor to prevent air flow restriction directed to the medially positioned grill of the housing, with a housing hood pivotally mounted to the support housing to provide protection and prevent access to the grill structure by small children and the like.

2 Claims, 4 Drawing Sheets

BARBEQUE GRILL HOUSING APPARATUS

BACKGROUND OF THE INVENTION

1. Field of the Invention

The field of invention relates to barbeque grill apparatus, and more particularly pertains to a new and improved barbeque grill housing apparatus wherein the same is arranged for mounting exteriorly of a balcony structure of an existing dwelling to afford protection to individuals relative to an associated barbeque grill, as well as permitting maximum utilization of space of the associated balcony structure.

2. Description of the Prior Art

Barbeque grill apparatus of various types is utilized throughout the prior art to permit outdoor cooking of various foods. A barbeque grill is frequently positioned within a balcony structure of an associated dwelling for convenience and access to the grill. Contemporary dwelling structure has limited available space of such balcony structure, wherein the instant invention attempts to provide a support housing to mount a grill exteriorly of a balcony structure, as well as affording limited access to children and the like preventing inadvertent injury relative to a barbecuing event. Barbeque apparatus is exemplified in the prior art in U.S. Pat. No. 4,836,480 to Besner illustrating a support frame for mounting a grill within the support frame.

U.S. Pat. No. 3,915,146 to Bauer sets forth a grill apparatus including a housing, wherein the housing includes a gas filled container for directing the gas as fuel into the grill structure.

U.S. Pat. No. 4,932,391 to Bierdeman sets forth a grill, wherein the grill includes a rotisserie structure for use with the grill structure.

As such, it may be appreciated that there continues to be a need for a new and improved barbeque grill housing apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of barbeque grill apparatus now present in the prior art, the present invention provides a barbeque grill housing apparatus wherein the same is arranged for mounting the grill in a protective arrangement within a support housing. As such, the general purpose of the present invention, which will be described subsequently in greater detail, is to provide a new and improved barbeque grill housing apparatus which has all the advantages of the prior art barbeque apparatus and none of the disadvantages.

To attain this, the present invention provides a housing apparatus arranged for use in combination with a barbeque grill for mounting to a balcony structure of an existing dwelling. The structure includes mesh side walls and a floor to prevent air flow restriction directed to the medially positioned grill of the housing, with a housing hood pivotally mounted to the support housing to provide protection and prevent access to the grill structure by small children and the like.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved barbeque grill housing apparatus which has all the advantages of the prior art barbeque apparatus and none of the disadvantages.

It is another object of the present invention to provide a new and improved barbeque grill housing apparatus which may be easily and efficiently manufactured and marketed.

It is a further object of the present invention to provide a new and improved barbeque grill housing apparatus which is of a durable and reliable construction.

An even further object of the present invention is to provide a new and improved barbeque grill housing apparatus which is susceptible of a low cost of manufacture with regard to both materials and labor, and which accordingly is then susceptible of low prices of sale to the consuming public, thereby making such barbeque grill housing apparatus economically available to the buying public.

Still yet another object of the present invention is to provide a new and improved barbeque grill housing apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
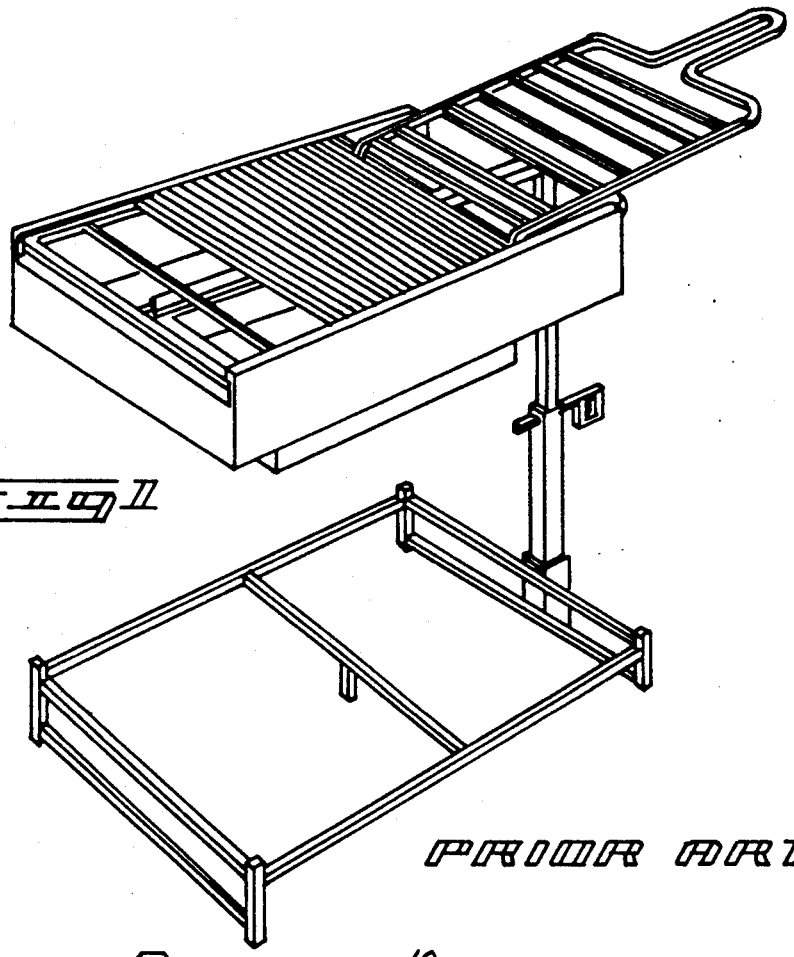
FIG 1 PRIOR ART
FIG. 1 is an isometric illustration of a prior art barbeque grill apparatus.
Figure 2:
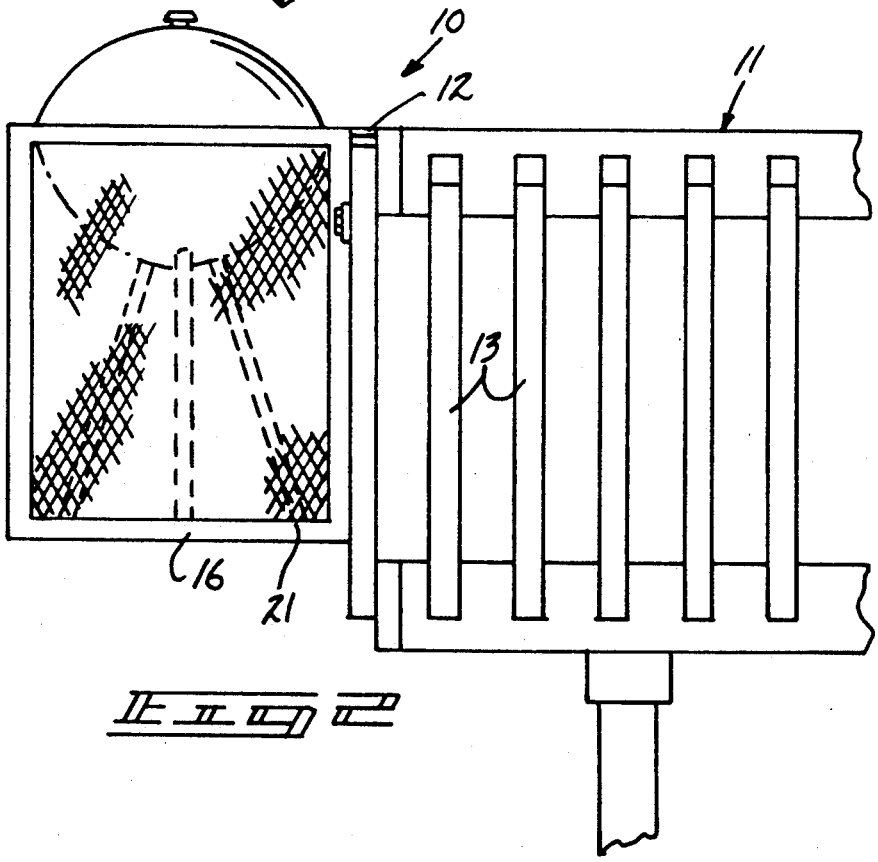
FIG. 2 is an orthographic side view of the invention.
Figure 3:
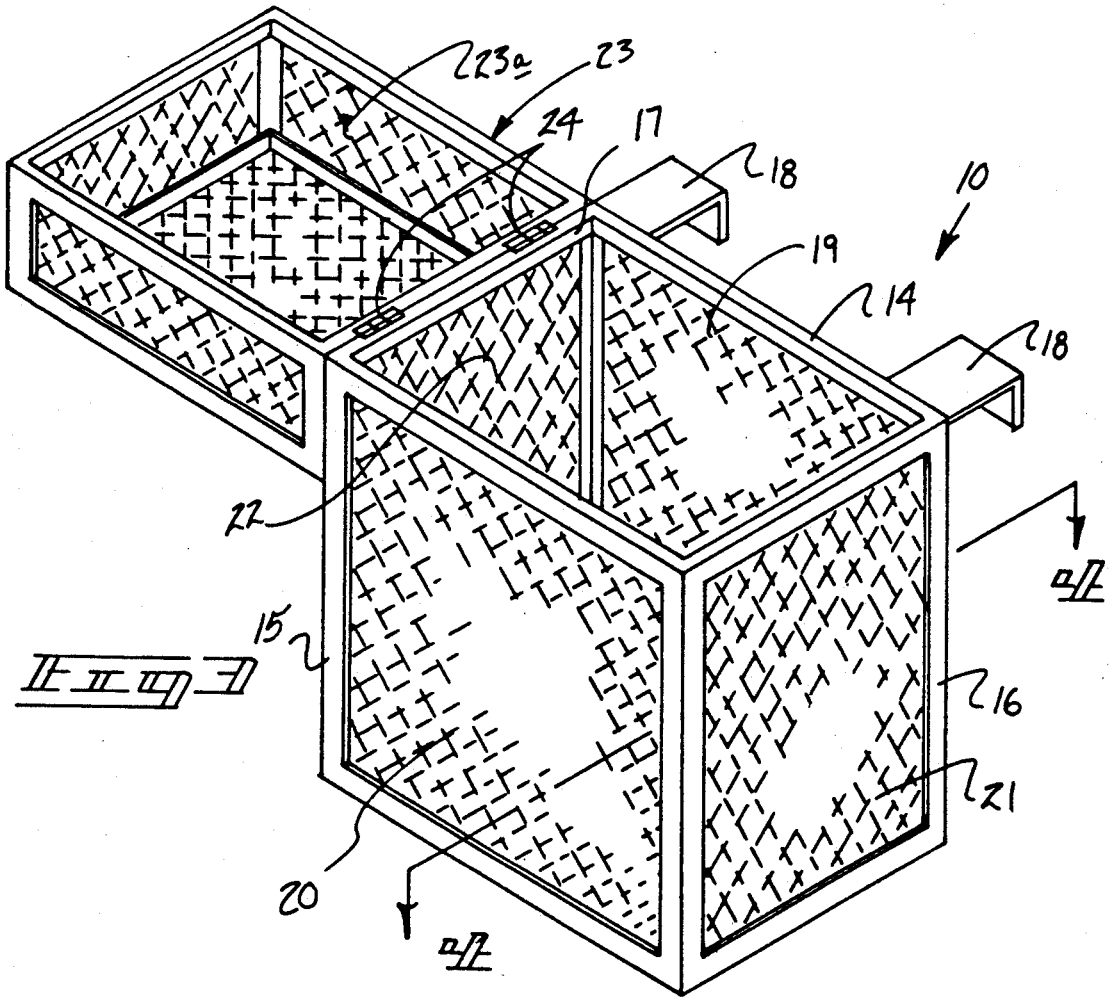
FIG. 3 is an isometric illustration of the housing of the invention.
Figure 4A:
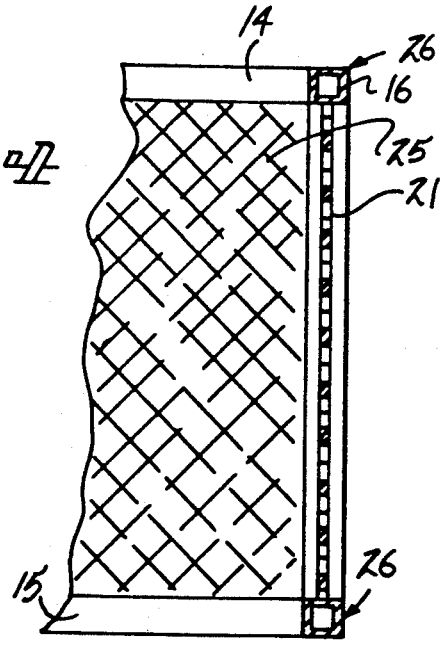
FIG. 4 is an orthographic view, taken along the lines 4—4 of FIG. 3 illustrating the floor of the housing.
Figure 5:
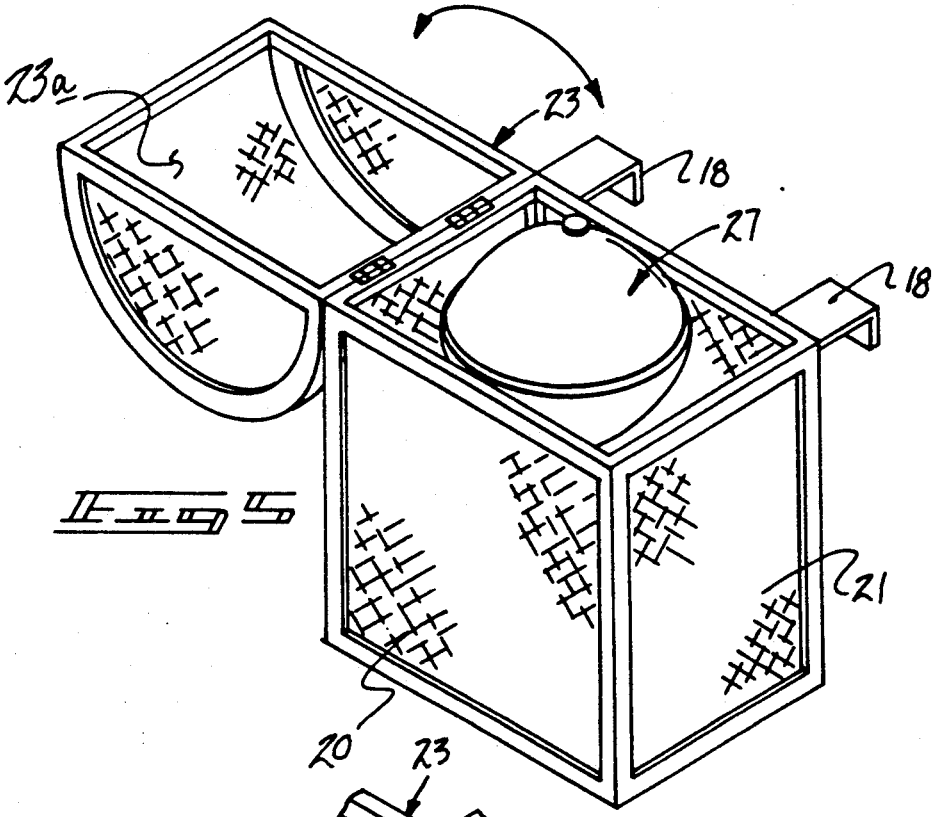
FIG. 5 is an isometric illustration of the housing illustrating the combination with a barbeque grill structure.

With reference now to the drawings, and in particular to FIGS. 1 to 7 thereof, a new and improved barbeque grill housing apparatus embodying the principles and concepts of the present invention and generally designated by the reference numeral 10 will be described.

FIG. 1 illustrates a prior art grill as set forth in U.S. Pat. No. 4,836,480, wherein a barbeque grill member is vertically adjustable relative to an underlying support.

More specifically, the barbeque grill housing apparatus 10 of the instant invention is illustrated for structural securement to a balcony 11 of a typical dwelling, wherein the balcony includes a horizontal rail 12 to accommodate mounting of the housing, with typical vertical bars 13 orthogonally oriented relative to the horizontal rail 12.

The housing includes a rigid rear wall frame 14 spaced from a rigid front wall frame 15, a rigid right side wall frame spaced from a rigid left side wall frame, wherein each frame includes an open mesh web mounted therewithin. As illustrated, the rear wall frame includes a rear mesh web 19, the front wall frame 15 includes a front mesh web 20, the right side wall frame 16 includes a right side mesh web 21, and the left side wall frame 17 includes a left side mesh web 22. A plurality of "L" shaped support flanges 18 are fixedly mounted to a top bar of the rear wall frame 14 and extend rearwardly of the top bar of the rear wall frame 14, with a vertical leg of each "L" shaped flange 18 arranged parallel to the rear mesh web 19 to receive the balcony horizontal rail 12 between each vertical leg of each "L" shaped flange 18 and the rear wall frame 14. A housing hood 23 includes at least one hinge 24 to pivotally mount the hood 23 to overlie a continuous perimeter defined by each horizontal leg of each wall frame. The housing hood 23 defines a hood cavity 23 to accommodate a barbeque grill 27 positioned within the walls of the housing apparatus. A housing floor mesh web 15 extends coextensively within the wall frames 14–17 to accommodate the barbeque grill 27. The wall frames 14 are interconnected by corner posts 26 that are orthogonally oriented relative to the housing floor mesh web 25.

Figure 6:
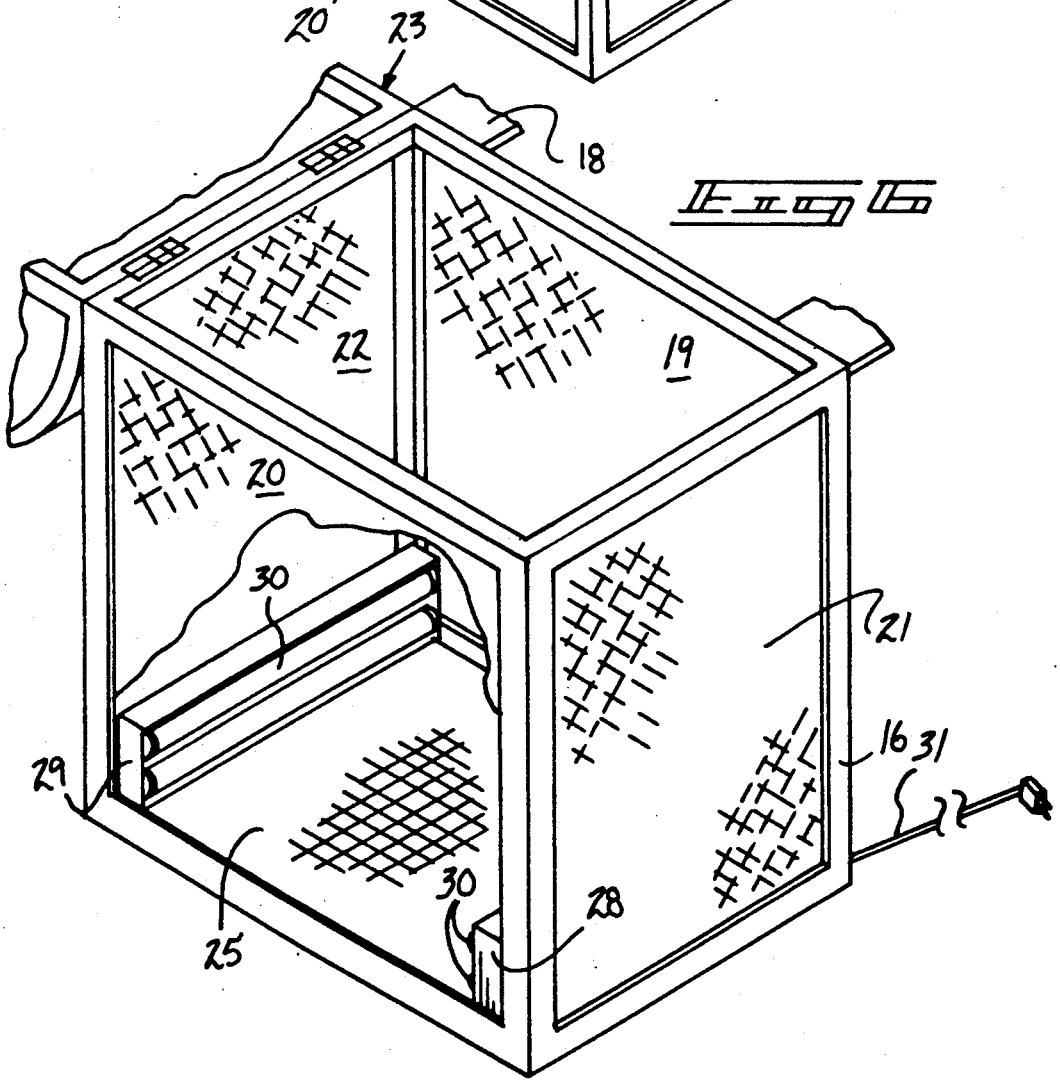
FIG. 6 is an isometric illustration of the housing apparatus utilizing illumination members therewithin.

FIG. 6 illustrates the housing including a plurality of illumination housings defined by a respective right and left illumination housing 28 and 29 mounted adjacent the floor mesh web 25 and coextensive with the right and left side wall frames 16 and 17. Each housing 28 includes at least one illumination bulb 30 therewithin to provide illumination to the organization, as well as to accommodate various illumination means for repelling flying insects. An electrical power cord 31 in conventional electrical communication with the housings 28 and 29 is arranged to extend exteriorly of the housing for association with a source of electrical power.

Figure 7:
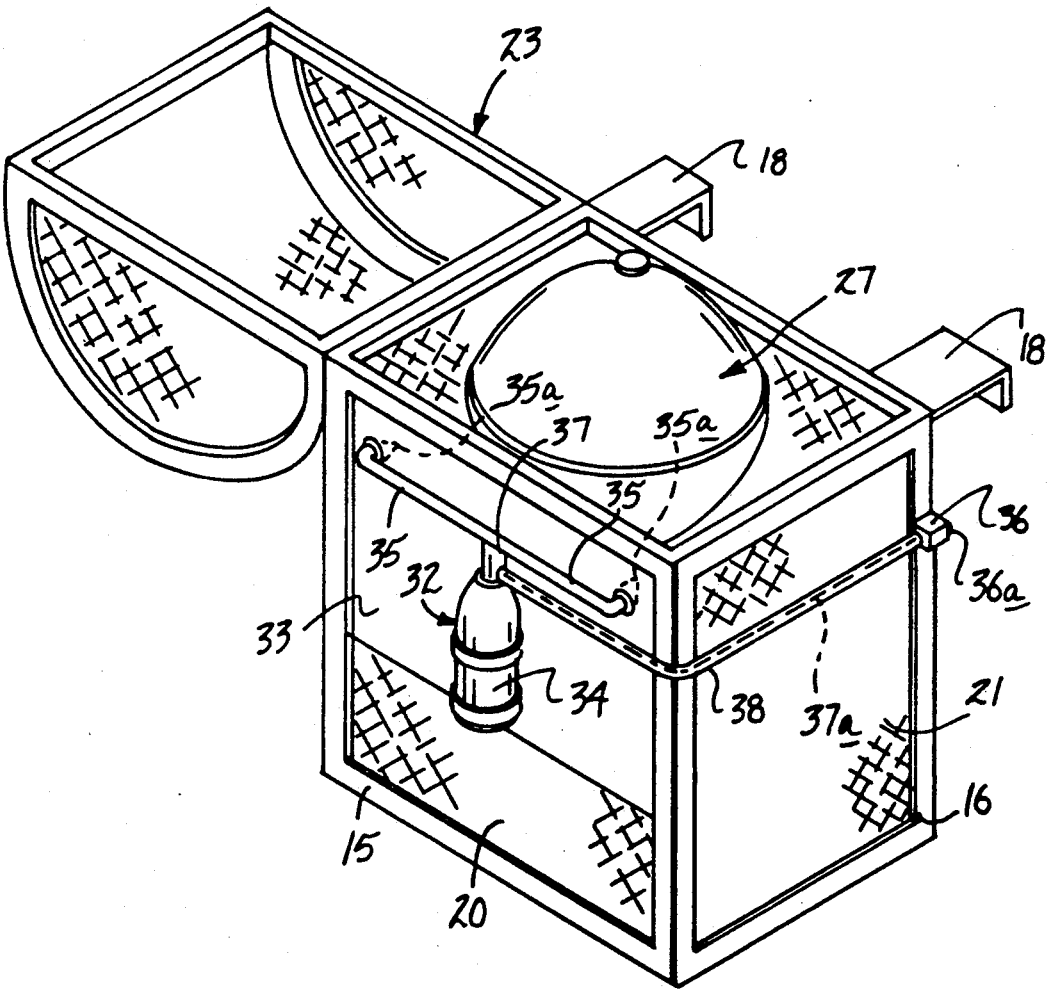
FIG. 7 is an isometric illustration of the invention illustrating the cumulative use of a fire extinguishing apparatus for use with the grill structure.

FIG. 7 illustrates the organization to further utilize a halogen gas dispensing unit 32 as required as a safety measure in use of the organization. The dispensing unit 32 may be mounted to the front wall mesh web 20 or to a front wall plate 33 mounted within the front wall frame 15 above and coextensive with the front mesh web 20. The dispensing unit includes a halogen gas canister 34 that includes a plurality of delivery conduits 35 directed through the front wall plate 33, with each conduit 35 including a nozzle 35*a* directed medially of the barbeque grill 27 to assist in extinguishment of fires inadvertently effected in use of the organization. The halogen gas canister 34 includes a canister valve 37 positioned between the delivery conduits 35 and the canister 34 that is actuated by a pull handle 36*a* mounted within an actuator switch housing 36 positioned in a remote orientation relative to the canister valve 37. The pull handle 36*a* includes a valve cable 37*a* directed through a valve cable guide conduit 38 that projects into the canister valve 37.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A barbeque grill housing apparatus, comprising, a housing having a unitary framework including a rectilinear rigid rear wall frame spaced from a rectilinear rigid front wall frame, and a rectilinear rigid right side wall frame spaced from a rectilinear left side wall frame, and the rear wall frame including a rear mesh web coextensively mounted within the rear wall frame, the front wall frame including a front mesh web coextensively mounted within the front wall frame, the right side wall frame including a right side mesh web coextensively mounted within the right side wall frame, and a left side mesh web coextensively contained within the left side wall frame, and a housing floor mesh web extending across a lower portion of the housing, and a barbeque grill member mounted on the housing floor mesh web, and a housing hood hingedly mounted to an upper terminal end of the left side wall frame arranged to overlie each wall frame, with the housing hood formed of a hood mesh web to permit ventilation into the housing, and a plurality of "L" shaped support flanges fixedly and orthogonally extending exteriorly of the rear wall frame, with each "L" shaped support flange of said "L" shaped support flanges including a vertical leg oriented parallel to the rear mesh web to receive a horizontal rail of a balcony member therewithin, and the housing floor mesh web includes a respective right and left illumination bulb housing mounted adjacent the housing floor mesh web, with the right illumination bulb housing mounted coextensively with the right side wall frame, and the left illumination bulb housing mounted coextensively with the left side wall frame, and each illumination bulb housing including at least one illumination bulb member therewithin arranged for selective illumination within the housing.

2. An apparatus as set forth in claim 1 wherein the front mesh web includes a front wall plate coplanar with and positioned above the front mesh web within the front wall frame, and the front wall plate including a halogen gas canister fixedly mounted to the front wall plate, with the halogen gas canister including a canister valve mounted to an upper terminal end thereof, and a plurality of delivery conduits mounted to the canister valve, whereupon actuation of the canister valve effects directing of halogen gas through the delivery conduits by way of the canister valve, and a valve cable guide conduit mounted exteriorly of the housing to include a valve cable contained and directed therethrough, with the valve cable including a pull handle mounted to a distal end of the valve cable, with the pull handle mounted within an actuator switch housing, wherein the actuator switch housing is mounted to the distal end of the valve cable guide conduit to permit actuation of the canister valve upon manual pulling of the pull handle relative to the switch housing.

* * * * *